US007390057B2

(12) United States Patent
Autterson

(10) Patent No.: US 7,390,057 B2
(45) Date of Patent: Jun. 24, 2008

(54) RECLOSABLE FASTENER RISER/SPACER, AND METHODS OF CONSTRUCTING AND UTILIZING SAME

(75) Inventor: Christopher S. Autterson, Novi, MI (US)

(73) Assignee: Argent International, Inc., Plymouth, MI (US)

( * ) Notice: Subject to any disclaimer, the term of this patent is extended or adjusted under 35 U.S.C. 154(b) by 352 days.

(21) Appl. No.: 11/162,499

(22) Filed: Sep. 13, 2005

(65) Prior Publication Data

US 2006/0078370 A1 Apr. 13, 2006

Related U.S. Application Data

(60) Provisional application No. 60/609,427, filed on Sep. 13, 2004.

(51) Int. Cl.
*B60R 13/02* (2006.01)

(52) U.S. Cl. ..... 296/214; 296/39.1; 24/306; 24/444

(58) Field of Classification Search ..... 296/214, 296/39.1; 24/306, 444; *B60R 13/02*
See application file for complete search history.

(56) References Cited

U.S. PATENT DOCUMENTS

| | | | | |
|---|---|---|---|---|
| 3,505,772 | A * | 4/1970 | De Claire et al. | 52/511 |
| 3,903,573 | A * | 9/1975 | Wilson | 411/548 |
| 5,179,767 | A * | 1/1993 | Allan | 24/442 |
| 5,280,991 | A * | 1/1994 | Weiland | 296/214 |
| 5,398,387 | A * | 3/1995 | Torigoe et al. | 24/452 |
| 5,667,896 | A * | 9/1997 | Carter et al. | 428/425.6 |
| 5,876,084 | A * | 3/1999 | Smith et al. | 296/39.1 |
| 6,019,411 | A * | 2/2000 | Carter et al. | 296/37.7 |
| 6,669,260 | B2 * | 12/2003 | Clark et al. | 296/37.8 |
| 6,779,835 | B2 * | 8/2004 | Fox et al. | 296/187.05 |
| 6,857,809 | B2 * | 2/2005 | Granata | 403/121 |
| 7,159,921 | B2 * | 1/2007 | Billarant et al. | 296/39.1 |
| 2006/0103172 | A1 * | 5/2006 | Veen et al. | 296/214 |

* cited by examiner

*Primary Examiner*—Dennis H. Pedder
*Assistant Examiner*—Mike Hernandez
(74) *Attorney, Agent, or Firm*—Weiner & Burt, P.C.; Irving M. Weiner; Pamela S. Burt

(57) ABSTRACT

A plastic spacer/riser to increase useable height of a reclosable fastening system, such as 3M™ Dual Lock™ or Velcro® hook and loop products. The spacer/riser is adapted to be held in place on an external substrate with hot-melt glue, sonic welds, pressure sensitive adhesives, or screws.

20 Claims, 2 Drawing Sheets

FIG 1
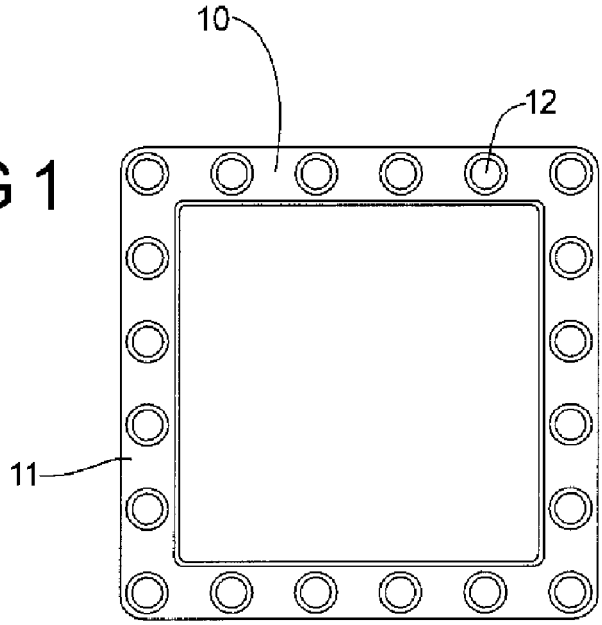
FIG 3
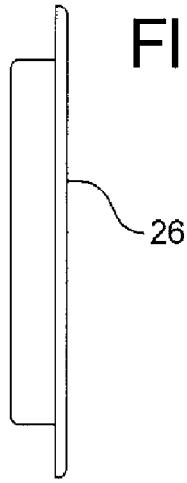
FIG 2
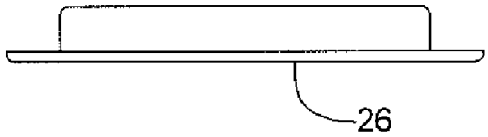
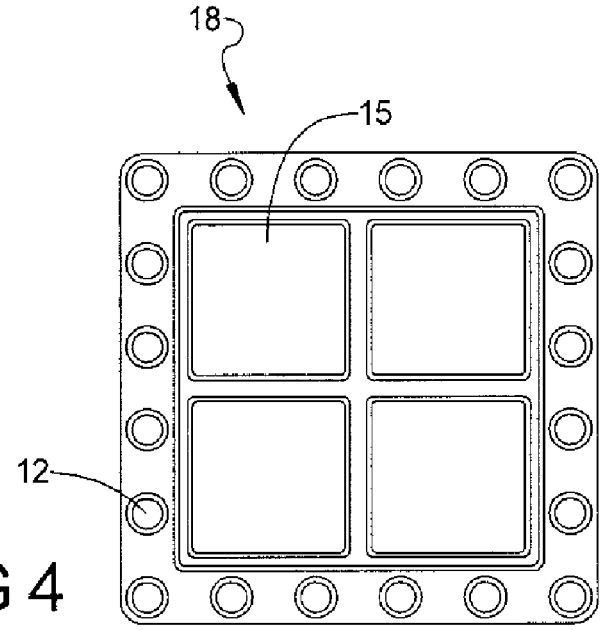
FIG 4
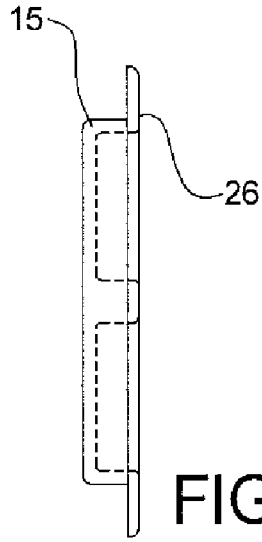
FIG 6
FIG 5
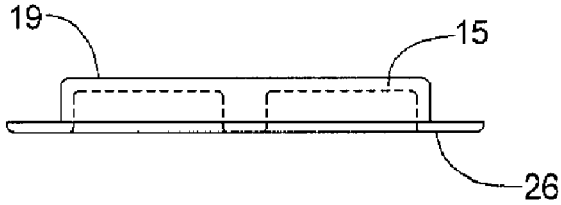

RECLOSABLE FASTENER RISER/SPACER, AND METHODS OF CONSTRUCTING AND UTILIZING SAME

The present patent application is a continuation-in-part of and claims priority from U.S. Provisional Patent Application Ser. No. 60/609,427 filed Sep. 13, 2004, the entire contents of which are incorporated herein by reference thereto.

The present invention relates generally to a reclosable fastener riser/spacer device, and methods of constructing and using same.

More particularly, the present invention relates to a plastic spacer/riser device to increase the useable height of reclosable fastening systems, such as, for example, 3M™ Dual Lock™ or Velcro® hook and loop products, and methods of constructing and utilizing same.

The term "reclosable fastener" as used herein means 3M™ Dual Lock™ fasteners, Velcro® hook and loop fasteners, and any other fastener that is selectively reclosable.

BACKGROUND OF THE INVENTION

Typically, reclosable fastening systems, such as, for example, 3M™ Dual Lock™ or Velcro® hook and loop products, are limited in their overall height or thickness in application.

Many times there is a need to increase the overall height or thickness of these fasteners.

For example, when using a reclosable fastener for fastening together the headliner of an automobile and the sheet metal portion roof of the automobile, oftentimes there is a space or gap between the parts of the reclosable fasteners which might necessitate the pushing in of the headliner, resulting in an uneven look with creases and folds and the like.

The present invention provides a device to increase the overall height, allowing more versatility in the use of reclosable fasteners in many different applications.

It is a desideratum of the present invention to avoid the animadversions of conventional reclosable fastening systems which are limited in their overall height or thickness in application.

SUMMARY OF THE INVENTION

The present invention provides a riser/spacer device for use with a reclosable fastener, comprising: a spacer member; a main spacer retainer member surrounding and unitary with said spacer member; said main spacer retainer member having a first retainer surface adapted to be secured to a first external substrate; said spacer member having a first spacer surface which is remote from said first retainer surface of said main spacer retainer member; and said first spacer surface being adapted to be secured to a first portion of said reclosable fastener.

The present invention further provides a spacer/riser device to increase the useable height of reclosable fastening systems, such as, for example, 3M™ Dual Lock™ or Velcro® hook and loop products.

It is a primary object of the present invention to provide a reclosable fastener riser/spacer product as described hereinabove, wherein such riser/spacer product may be fabricated by injection molding out of materials such as ABS, polypropylene, polyethylene, or any suitable material.

Another object of the present invention is to provide such a riser/spacer device as described hereinabove, which allows reclosable fastening systems to have more versatility in applications.

Another object of the present invention is to provide such a riser/spacer device as described hereinabove, wherein the riser/spacer device is designed to be held in place on a mating substrate with hot-melt glue, sonic welding, pressure sensitive adhesive, screws, or other securement means.

The foregoing objects, advantages and features of the present invention will become apparent to those persons skilled in this particular area of technology and to other persons after having been exposed to the following detailed description of the present invention and read in conjunction with the accompanying patent drawings.

For a better understanding of the present invention, and to show more clearly how it may be carried into effect, reference will now be made, by way of example, to the accompanying drawings, which show a preferred embodiment of the present invention, and in which:

BRIEF DESCRIPTION OF THE DRAWINGS

FIG. 1 illustrates a top plan view of a spacer/riser device in accordance with a preferred embodiment of the invention.

FIG. 2 shows a front elevational view of the FIG. 1 device.

FIG. 3 shows a side elevational view of the FIG. 1 device.

FIG. 4 illustrates a bottom view of the FIG. 1 device.

FIG. 5 is a view similar to FIG. 2 but showing the internal structure of the spacer in phantom line.

FIG. 6 is a view similar to FIG. 3 but showing the internal structure of the spacer in phantom line.

DETAILED DESCRIPTION OF THE PREFERRED EMBODIMENT

Figure 7:
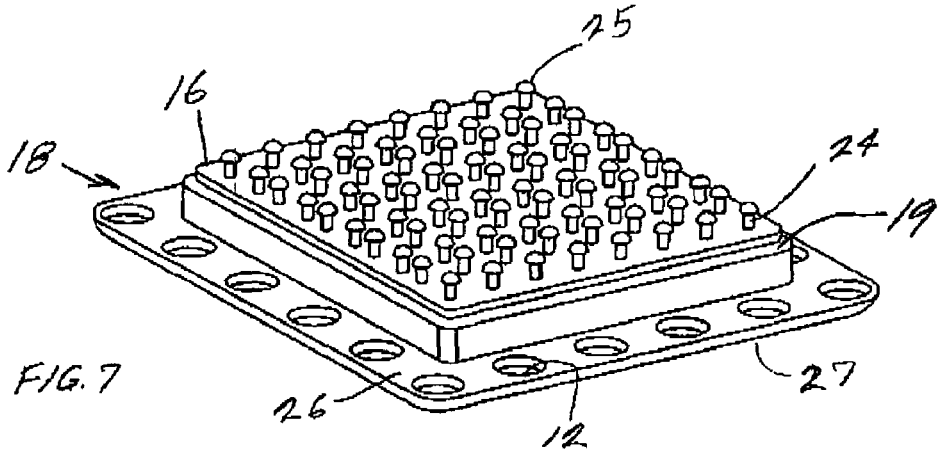
FIG. 7 is an isometric drawing showing the device having affixed thereon one portion of a 3M™ Dual Lock™ reclosable fastener.

With reference to FIGS. 1-6, there is a preferred embodiment of the present invention in the form of an unitarily-molded spacer/riser device 18 having a main spacer retainer member 10 and a spacer 15.

Preferably, but not necessarily, the main spacer retainer member 10 is provided around its outer periphery 11 with a series of apertures 12.

Figure 8:
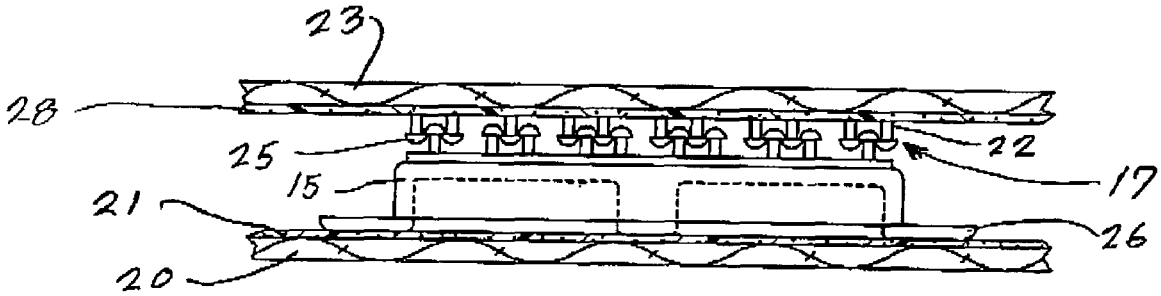
FIG. 8 shows a side elevational view, partly in section, of the riser/spacer device of the present invention as used with a particular reclosable fastener system.

The main spacer retainer member 10 is provided with a base member 26 having a lower surface 27, as best shown in FIG. 8.

The main spacer retainer member 10 surrounds one or more spacer members 15, the height of which is dependent upon the increase in height or gap to be filled between external substrates 20 and 23.

Preferably, but not necessarily, the device 18 is injection molded from materials such as ABS, polypropylene, polyethylene, or other plastics.

With reference to FIG. 7, there is shown the device 18 having affixed at the top surface 19 thereof a first portion 16 of a reclosable fastener 17, such as a 3M™ Dual Lock™ reclosable fastener.

With reference to FIG. 8, there is shown the device 18 having the lower surface portion 27 of its base number 26 secured to a first external substrate 20, such as the sheet metal roof of an automobile, by hot-melt glue, sonic welding, pressure sensitive adhesive or other securement means 21. A second portion 22 of the reclosable fastener 17, such as a 3M™ Dual Lock™ reclosable fastener, is secured to a second external substrate 23 (for example, the headliner of an automobile) by hot-melt glue, sonic welding, pressure sensitive adhesive or other securement means 28.

With reference to FIGS. 7 and 8, the purpose of the apertures 12 in the main spacer retaining member 10 is to permit hot-melt glue or other adhesive to move therethrough, or screws to pass therethrough, when securing member 10 to an external substrate 20.

With reference to FIG. 8, the 3M™ Dual Lock™ reclosable fastener 17 will operate in the normal fashion with the mushroom heads 25 on the rigid plastic stems 24 releasably interlocked. The 3M Dual Lock reclosable fasteners 17 are self-mating, that is the fasteners 17 simply reattach to themselves. When pressed together, thousands of mushroom heads 25 interlock with one another creating an audible snap that announces that the fastener portions 16 and 22 are interlocked.

While the present invention has been described hereinabove with respect to only one preferred embodiment for illustrative purposes only, it should be understood that the present invention encompasses and embraces all modifications, variations, and changes in the basic inventive concept.

Also, the variations and modifications are intended to be embraced within the scope of the present invention and the present patent application.

What is claimed is:

1. A spacer/riser device, comprising, in combination:

a rigid, one-piece, non-deformable, non-flexible hat-shaped spacer/riser device;

said rigid, one-piece, non-deformable, non-flexible hat-shaped spacer/riser device having a flat top surface and a flat bottom surface;

said flat top surface is parallel to said flat bottom surface;

said rigid, one-piece, non-deformable, non-flexible hat-shaped spacer/riser device includes a spacer member completely surrounded by a main spacer retainer member;

said spacer member is unitary with said main spacer retainer member to form said rigid, one-piece, non-deformable, non-flexible hat-shaped spacer/riser device;

said spacer member forms a crown of said rigid, one-piece, non-deformable, non-flexible hat-shaped spacer/riser device;

said main spacer retainer member forms a brim of said rigid, one-piece, non-deformable, non-flexible hat-shaped spacer/riser device;

said spacer member having an uppermost surface which is said flat top surface of said rigid, one-piece, non-deformable, non-flexible hat-shaped spacer/riser device;

said main spacer retainer member having a lowermost surface which is said flat bottom surface of said rigid, one-piece, non-deformable, non-flexible hat-shaped spacer/riser device; said spacer member having a parallelepiped shape with a first square perimeter;

said main spacer retainer member having a parallelepiped shape with a second square perimeter;

said second square perimeter is concentric with and larger than said first square perimeter;

first and second planar external substrates;

said first planar external substrate being disposed parallel to said second planar external substrate;

said first and second external substrates are not coplanar;

first securement means permanently affixing said main spacer retainer member to said first planar external substrate at said flat bottom surface of said rigid, one-piece, non-deformable, non-flexible hat-shaped spacer/riser device;

a reclosable fastener including a first fastener member and a second fastener member;

second securement means permanently affixing said first fastener member of said reclosable fastener to said spacer member at said flat top surface of said rigid, one-piece, non-deformable, non-flexible hat-shaped spacer/riser device; and third securement means permanently affixing said second fastener member of said reclosable fastener to said second planar external substrate;

whereby said first and second fastener members are releasably interlocked with each other to maintain said first and second planar external substrate parallel to each other and without folds and creases in said first and second planar external substrates.

2. A spacer riser device according to claim 1, wherein:

said brim of said rigid, one-piece, non-deformable, non-flexible hat-shaped spacer/riser device is provided with a plurality of apertures to permit said first securement means to pass therethrough when permanently affixing said main spacer retainer member to said first planar external substrate at said flat bottom surface of said rigid, one-piece, non-deformable, non-flexible hat-shaped spacer/riser device.

3. A spacer riser device according to claim 1, wherein:

said spacer member is partially hollow.

4. A spacer riser device according to claim 2, wherein:

said spacer member is partially hollow.

5. A spacer riser device according to claim 1, wherein:

said rigid, one-piece, non-deformable, non-flexible hat-shaped spacer/riser device has a height which is determined at least in part by a gap to be filled between said first and second planar external substrates.

6. A spacer riser device according to claim 2, wherein:

said rigid, one-piece, non-deformable, non-flexible hat-shaped spacer/riser device has a height which is determined at least in part by a gap to be filled between said first and second planar external substrates.

7. A spacer riser device according to claim 3, wherein:

said rigid, one-piece, non-deformable, non-flexible hat-shaped spacer/riser device has a height which is determined at least in part by a gap to be filled between said first and second planar external substrates.

8. A spacer riser device according to claim 4, wherein:

said rigid, one-piece, non-deformable, non-flexible hat-shaped spacer/riser device has a height which is determined at least in part by a gap to be filled between said first and second planar external substrates.

9. A spacer riser device according to claim 1, wherein:

said first planar external substrate comprises a roof of a vehicle; and said second planar external substrate comprises a headliner of the vehicle.

10. A spacer riser device according to claim 2, wherein:

said first planar external substrate comprises a roof of a vehicle; and said second planar external substrate comprises a headliner of the vehicle.

11. A spacer riser device according to claim 3, wherein:

said first planar external substrate comprises a roof of a vehicle; and said second planar external substrate comprises a headliner of the vehicle.

12. A spacer riser device according to claim 4, wherein:

said first planar external substrate comprises a roof of a vehicle; and said second planar external substrate comprises a headliner of the vehicle.

13. A spacer riser device according to claim 5, wherein:

said first planar external substrate comprises a roof of a vehicle; and said second planar external substrate comprises a headliner of the vehicle.

14. A spacer riser device according to claim 6, wherein:

said first planar external substrate comprises a roof of a vehicle; and said second planar external substrate comprises a headliner of the vehicle.

15. A spacer riser device according to claim 7, wherein:

said first planar external substrate comprises a roof of a vehicle; and said second planar external substrate comprises a headliner of the vehicle.

16. A spacer riser device according to claim 8, wherein:

said first planar external substrate comprises a roof of a vehicle; and said second planar external substrate comprises a headliner of the vehicle.

17. A spacer riser device according to claim 1, wherein:

said first square perimeter has sides which are disposed parallel to adjacent respective sides of said concentric second square perimeter.

18. A spacer riser device according to claim 2, wherein:

said first square perimeter has sides which are disposed parallel to adjacent respective sides of said concentric second square perimeter.

19. A spacer riser device according to claim 3, wherein:

said first square perimeter has sides which are disposed parallel to adjacent respective sides of said concentric second square perimeter.

20. A spacer riser device according to claim 16, wherein:

said first square perimeter has sides which are disposed parallel to adjacent respective sides of said concentric second square perimeter.

* * * * *